US005328170A

United States Patent [19]

Coombs et al.

[11] Patent Number: 5,328,170

[45] Date of Patent: Jul. 12, 1994

[54] LOCKED DRAWER SORTER

[75] Inventors: Peter M. Coombs, Tustin; Bradford Billings, Lake Forest, both of Calif.

[73] Assignee: Gradco (Japan) Ltd., Tokyo, Japan

[21] Appl. No.: 849,223

[22] Filed: Mar. 10, 1992

[51] Int. Cl.[5] ..... B65H 39/10

[52] U.S. Cl. ..... 271/297; 271/305; 271/213; 109/53

[58] Field of Search ..... 271/278, 279, 292, 297, 271/303, 207, 213, 220; 109/53, 56, 57; 209/534

[56] References Cited

U.S. PATENT DOCUMENTS 4,928,230 5/1990 Kawamura et al. ..... 209/534 X

FOREIGN PATENT DOCUMENTS 8704281 7/1987 World Int. Prop. O. ..... 271/207

*Primary Examiner*—Robert P. Olszewski
*Assistant Examiner*—Boris Milef
*Attorney, Agent, or Firm*—Newton H. Lee, Jr.

[57] ABSTRACT

A random access sorter has a plurality of trays in a vertical stack into which are deposited sheets of printed material from an office printer, facsimile machine or other source of printed sheets. The sorter has a sheet transport and gates at the respective trays to deflect sheets from the transport in a selected tray. Each tray is in the form of a drawer normally locked in a sheet receiving position. A gate closing device closes the selected gate to a sheet deflecting position from a normal position permitting the sheet to pass by the trays. The gate closing actuator device is also an actuator for selectively unlocking the drawers which are normally locked.

2 Claims, 3 Drawing Sheets

LOCKED DRAWER SORTER

BACKGROUND OF THE INVENTION

Office printers and facsimile machines have evolved which are used in a relatively free or open office environment. The output from such office machines may be generated at various remote locations and may be designated for a number of different recipients. Frequently, there is a need for confidentiality of the material received in one or more of the trays, but, typically, the material in the receivers or sorters for the output of such office machines is deposited in un-sorted or, if sorted or separated as between different documents, in clear view of the entire office staff and anyone has access to any document so deposited. Particularly, this is a security problem when the documents are received during non-working hours when the printer or facsimile may be generating output over night, say, from networked computers or facsimile senders anywhere in the world.

The security of documents is especially useful with sorters which are useful as random access sorters or mailboxes, such as the typical sorters employing deflectors, including moving nips, or gates to deposit sheets in a selected tray, as shown for exmaples, in U.S. Pat. Nos. 4,235,435 and 4,691,914 issued to Lawrence.

SUMMARY OF THE INVENTION

The present invention provides a sorter or receiver for the output from a printer, facsimile machine or the like which can distribute different documents to different sorter trays, at random, on command from the printer, so as to constitute a mailbox in which the selected document is designated for a certain recipient.

In addition, the present invention provides such a sorter or receiver which receives the selected output from the printer in locked boxes, so that office workers or other persons not designated as the recipient cannot readily gain access to the document in any given tray, so as to constitute a locked mailbox to which only the certain designated recipient may have access to the document.

To accomplish the foregoing, the invention may utilize a sorter of the type having a set of trays or bins arranged in a vertical stack and having ends of the tray spaced apart adjacent to a sheet transport which carries sheets from the host printer, or the like, in a vertical path at the ends of the trays, wherein sheet deflectors or gates are normally open to permit the transport to carry sheets past the tray ends but are actuatable to a closed position obstructing the sheet path to deflect the sheet from the transport to the tray. In conjunction with such a sorter, an actuator mechanism is provided which is operable to selectively cause any of the deflectors or gates to be actuated to the closed position, either randomly for purposes of mailboxing or segregating jobs, or if used, simply for sorting sets the actuator may be operated sequentially.

In order to provide security for the documents in the sorter trays, the trays are adapted to be normally locked against access and a mechanism is provided for selectively unlocking a selected tray. Specifically the trays are formed as drawers to receive the documents, and the drawers are normally locked, but an actuator mechanism is provided to selectively unlock a drawer at random.

More particularly, the actuator for selectively causing the deflectors or gates to move a sheet from the transport and deflect the sheet to a tray incorporates a vertically extended actuator shaft having outwardly projecting portions spaced vertically for engaging and moving a selected deflector or gate to its operative position upon partial rotation of the actuator shaft depending upon the location of the actuator shaft in a vertical direction, together with a mechanism for incrementally vertically moving the actuator shaft to a selected position at which rotative movement of the shaft actuates a selected deflector or gate.

The mechanism for selectively unlocking the normally locked trays is similar to the mechanism for selectively closing the deflectors or gates, and in the illustrative embodiment the mechanism for performing both functions is incorporated in a combined or dual function mechanism. The normally locked trays are adapted to be selectively unlocked responsive to the extent to which the locking shaft is shifted vertically and partial rotation of the shaft in the opposite direction from deflector actuating partial rotation of the shaft.

The invention has other features and advantages which will become apparent from the specification and drawings forming a part hereof.

DESCRIPTION OF THE PREFERRED EMBODIMENT

Figure 1:
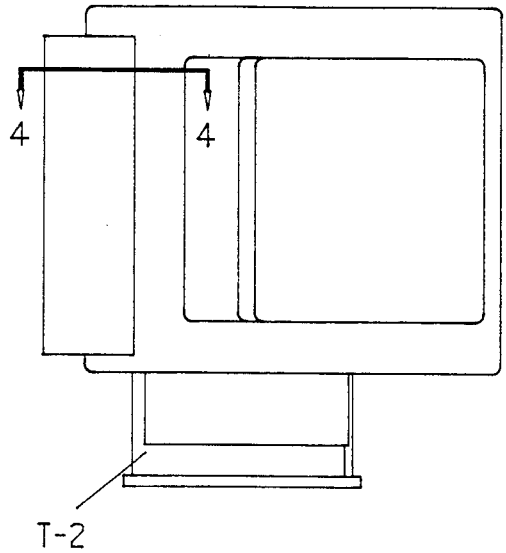
FIG. 1 is a top plan of the apparatus of the invention together with a printer, showing one tray drawer open.
Figure 3:
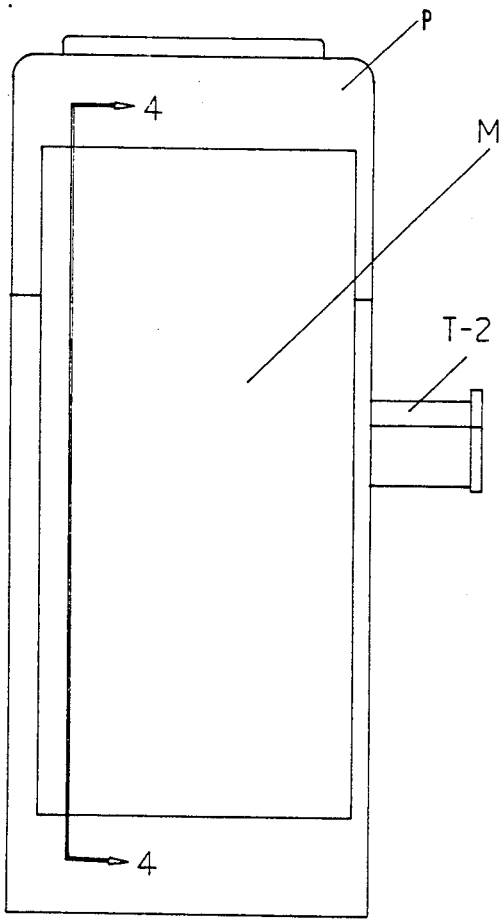
FIG. 3 is a right side elevation thereof.
Figure 2:
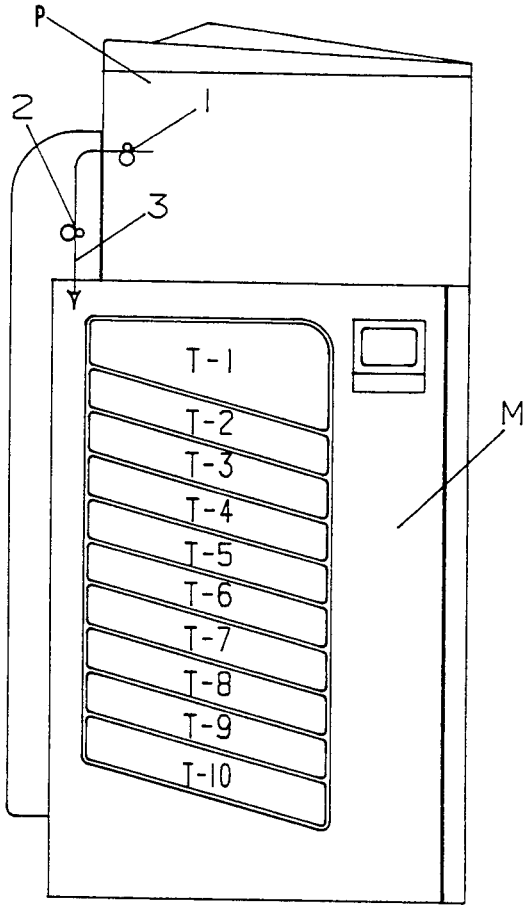
FIG. 2 is a left side elevation thereof.

Referring first to FIGS. 1–3 a sorter mailbox M is shown with a printer P mounted on top of the sorter housing. The sorter has a plurality of vertically spaced drawers or trays T, one of which is shown in an open position to allow removal of documents. The printer has sheet exit rolls 1 adapted to supply sheets to infeed rolls 2 for the sorter, to feed sheets as indicated by the arrow 3.

Figure 4:
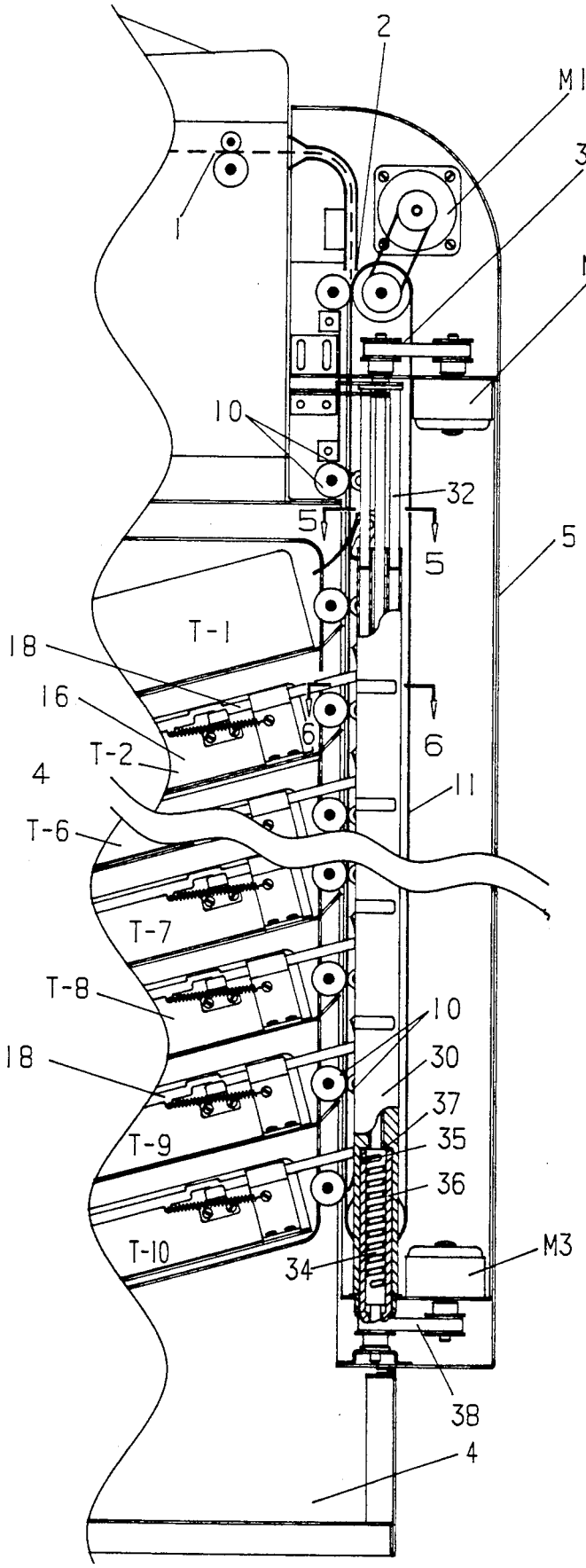
FIG. 4 is an enlarged vertical section on the line 4—4 of FIG. 3.
Figure 5:
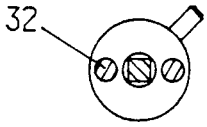
FIG. 5 is a detail section on the line 5—5 of FIG. 4.

As seen in FIG. 4, the sorter has a main housing 4 and at one side operating mechanism for the sorter is in a housing section 5. Sheet transporting means are provided to carry sheets from infeed rolls 2 vertically, in this case, downwardly past the sheet inlet side of the set of vertically spaced sheet receiving trays T designated T1 through T10 from top to bottom, respectively. Tray T1 is a simple non-sort receiver tray for receiving unsorted non-secured documents. Trays T2 through T10 are all in the form of drawers which can be pulled outwardly from the housing, as seen in FIGS. 1 and 3.

Figure 9:
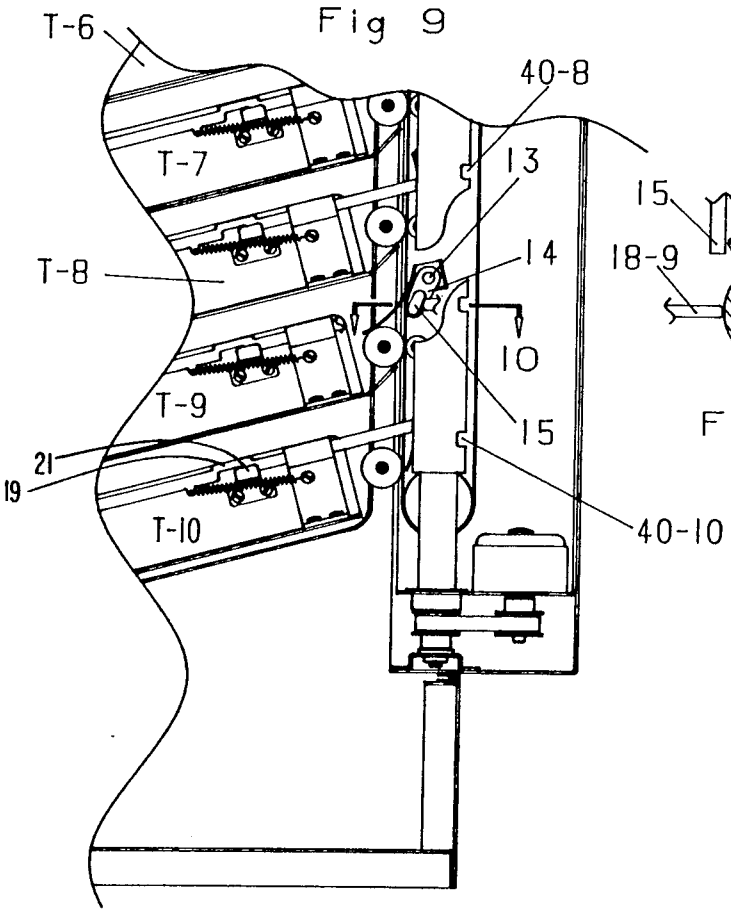
FIG. 9 is a view corresponding with the lower portion of FIG. 4, but showing one gate closed.

The sheet transport may be any known type, but as shown includes vertically spaced opposing sets of rollers 10 and a suitable number of driven belts 11, spaced transversely of the sheet feeding direction to provide the sheet drive and driven by a feed motor M1, as is well known in the art so as to require no further illustration or description herein. A deflector or pivoted gate 12 is provided at each set of vertically spaced rolls 10, one of which is best seen at tray T9 in FIG. 9, such deflector gates are well known, and generally there are a series of fingers horizontally spaced, between the belts 11 on a common rock shaft 13, so that rocking of the shaft will swing the fingers into the paper path and divert the sheet into the associated tray. Equivalent transports and gates or deflectors are shown in the above-identified Lawrence patents. Referring to FIG. 9 briefly, for purposes of rocking the shafts 13, at one end of the shaft is an arm 14 having an outstanding projection 15 adapted to be engaged by an actuator A later described.

It is desired that the drawers constituting trays T2 through T10 be normally locked and selectively unlocked. Each of said drawers has on its inner, rear wall 16 a support bracket 17 slidably supporting a lock or latch rod 18 formed with a relief or lock release, notched portion 19. Rods 18 are biased towards actuator A by a spring 20 so that the release portion 19 is out of registry with lock lug 21 on the rear wall of the drawers. However, when the rod 18 is permitted to move relative to the actuator A by the spring force, the lock lug is disposed in the lock release portion 19, permitting the associated drawer to be pulled outwardly.

As indicated above, both the gate actuator and the locking action are controlled by actuator means A. The actuator means comprises a vertically extended tubular shaft rotatably 30 mounted on a fixed square rod 31 extending co-axially through shaft 30. At its upper end, shaft 30 is longitudinally shiftably engaged by tines 32 extending downwardly from a pulley 33 which is driven by an electric stepper motor M2 which is reversible to turn the shaft 30 incrementally in opposite direction from a normal position shown in FIG. 4, at which all drawers are locked and any sheets entering the sheet transport will be deflected into the top receiver tray T1.

In addition, the shaft 30 is adapted to be vertically displaced on the tines 32 by another electric stepper motor M3. At the lower end of actuator shaft 30 is a bore rotatably receiving a sleeve 34 having an internal pin 35 engaging a helical groove of a threaded inner sleeve 36. The sleeve 36, as is shown, is rotatable by the motor M3. Fixed rod 31 may have a square or other connection with threaded sleeve 36 enabling vertical displacement of threaded sleeve 36 which shoulders at 37 in actuator shaft 30 for moving the latter up or down as needed and as a result of the direction of rotation of the drive 38 from motor M3 to sleeve 31. Thus, actuator shaft 30 is vertically shiftable in increments by means which is independent of the means to either hold the shaft against rotation or cause partial rotation of the shaft in either direction for purposes now to be described.

Figure 6:
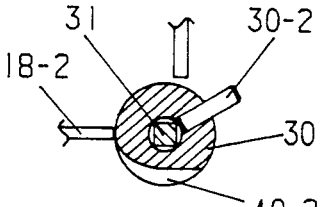
FIG. 6 is a detail section on the line 6—6 of FIG. 4.
Figure 7:
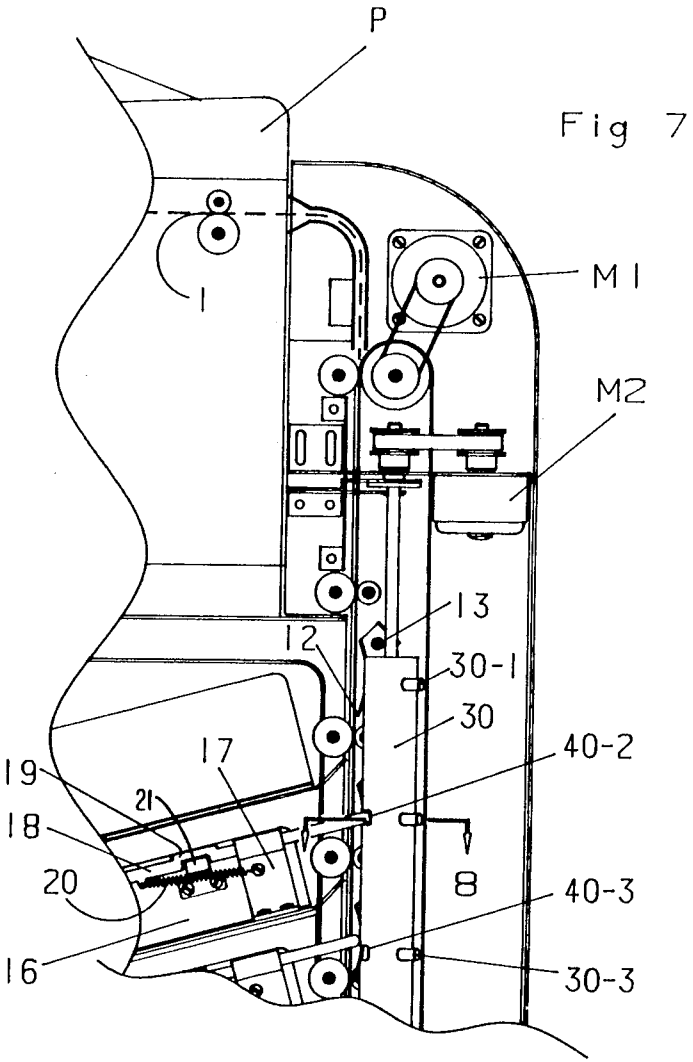
FIG. 7 is a view corresponding with the upper portion of FIG. 4, but showing one drawer unlocked.
Figure 10:
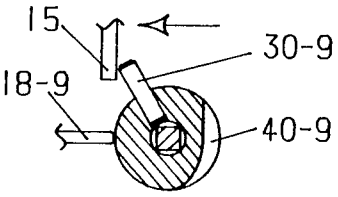
FIG. 10 is a detail section on the line 10—10 of FIG. 9.

For actuating the gates to closed position, the actuator shaft has a plurality of radially projecting pins or lugs which are spaced vertically of the shaft 30, the pin shown in FIG. 6 is designated 30-2 because it is adapted to close the gate at bin T2. Thus, the pins are referred to as pins 30-1 through 30-10 as determined by the tray T1 through T10 into which sheets are to be deflected. The spacing of the pins along the shaft 30 and the lead of the spiral groove in actuator sleeve 36 are determinative of which pin 30-1 through 30-10 will be operative to close the gate at the associated tray. Gate closure occurs upon partial rotation of shaft 30 from the position of FIG. 6 to the position of FIG. 10, whereby the rock shaft for the related gate is pivoted.

Figure 8:
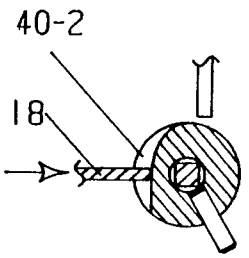
FIG. 8 is a detail section on the line 8—8 of FIG. 7.

Similarly, the locks for the drawers are controlled by the vertical disposition of the shaft 30 and partial rotation of the shaft in the opposite direction from gate closing rotation. The drawers are all normally locked since the outer ends of all lock rods 18 are all normally engaged with the outer periphery of the shaft 30. At suitably vertically spaced positions in the shaft 30, it is formed with chordal recesses 40-2 through 40-10 into which one of the lock rod ends is biased by its locking spring and depending upon the vertical positioning of the shaft 30, as described above, and responsive to rotation of the shaft, as illustrated, as for example in FIG. 8 as compared with FIG. 6.

Having thus described an illustrative embodiment of the invention, what is claimed is:

1. A sorter for use with a sheet printing machine comprising: a housing, a plurality of sorter trays disposed in said housing in longitudinally extended vertically spaced relation, sheet feeding means for directing sheets to said trays to form sets of sheets, said trays being slidably supported in said housing to be partially removed from said housing, means normally locking said trays in said housing against sliding movement, and means selectively operable to release the locking means for one of said trays while the rest of said trays remain locked by said locking means, said sheet feeding means including a deflector at each tray normally permitting travel of a sheet past the trays, each said deflector being individually shiftable to a position to direct a sheet into a selected tray, and including actuator means for selectively shifting one of said deflectors to said position directing a sheet to a tray, said means to release the locking means for one of said trays being incorporated in said actuator means for independent operation to release the locking means or to shift one of said deflectors.

2. A sorter for use with a sheet printing machine comprising: a housing, a plurality of sorter trays disposed in said housing in longitudinally extended vertically spaced relation, sheet feeding means for directing sheets to said trays to form sets of sheets, said trays being slidably supported in said housing to be partially removed from said housing, means normally locking said trays in said housing against sliding movement, and means selectively operable to release the locking means for one of said trays while the rest of said trays remain locked by said locking means, said sheet feeding means includes a deflector at each tray normally permitting travel of a sheet past the trays, each said deflector being individually shiftable to a position to direct a sheet into a selected tray, said means normally locking said trays including a latch bar normally in a tray locking position and shiftable to a tray unlocking position, and actuator means selectively operable either to cause shifting of a selected deflector to a position directing a sheet into one of said trays or to allow shifting of one of said latch bars to its unlocking position, said actuator means including a vertical shaft having a plurality of deflector actuating portions spaced vertically thereon, a plurality of latch bar engaging portions spaced vertically on said shaft normally holding said latch bars in tray locking position and latch bar releasing portions spaced vertically on said shaft and angularly displaced from said latch bar engaging portions, means for incrementally vertically shifting said shaft to selected positions to effect either shifting of a deflector or release of a latch bar upon partial rotation of said shaft in opposite directions, and means for partially rotating said shaft in opposite directions.

* * * * *